US007600885B2

(12) United States Patent
Canino et al.

(10) Patent No.: US 7,600,885 B2
(45) Date of Patent: Oct. 13, 2009

(54) DRILL INCORPORATING DETACHABLE RECHARGEABLE FLASHLIGHT MODULE

(75) Inventors: Serafino Canino, Torrington, CT (US); Scott Gelormino, Torrington, CT (US)

(73) Assignee: ICC Innovative Concepts Corporation, Canton, CT (US)

( * ) Notice: Subject to any disclaimer, the term of this patent is extended or adjusted under 35 U.S.C. 154(b) by 86 days.

(21) Appl. No.: 11/505,014

(22) Filed: Aug. 16, 2006

(65) Prior Publication Data

US 2008/0043459 A1 Feb. 21, 2008

(51) Int. Cl.
*B25B 23/18* (2006.01)

(52) U.S. Cl. ..... 362/119; 362/120

(58) Field of Classification Search ..... 362/119, 362/120

See application file for complete search history.

(56) References Cited

U.S. PATENT DOCUMENTS 3,952,239 A * 4/1976 Owings et al. ..... 320/113
5,169,225 A 12/1992 Palm
6,575,590 B1 * 6/2003 Wadsworth ..... 362/119
6,965,205 B2 * 11/2005 Piepgras et al. ..... 362/800
7,093,951 B2 * 8/2006 Tsuruta et al. ..... 362/119
2005/0157489 A1 * 7/2005 Oomori et al. ..... 362/119
2006/0262519 A1 * 11/2006 Hirschburger et al. ..... 362/119
2007/0256914 A1 * 11/2007 Lohr et al. ..... 200/5 A
2007/0279000 A1 * 12/2007 Lucero ..... 320/112

* cited by examiner

*Primary Examiner*—Sandra L O'Shea
*Assistant Examiner*—William J Carter
(74) *Attorney, Agent, or Firm*—Anthony H. Handal; Thompson Hine LLP

(57) ABSTRACT

A multiple function tool comprising a tool housing is disclosed. An electrically powered tool is contained within the tool housing. At least one electrical tool contact is associated with the housing. A battery housing mates with and is secured to the tool housing when the battery housing is positioned on the tool housing in a use position. A rechargeable battery is contained within the battery housing. At least one battery contact is positioned to be connected to the electrical tool contact when the battery housing is mounted on the tool housing in the use position. A light emitting device is positioned at one end of the battery housing. The light emitting device is electrically connected to the battery. A switch couples the battery to the light emitting device.

20 Claims, 8 Drawing Sheets

DRILL INCORPORATING DETACHABLE RECHARGEABLE FLASHLIGHT MODULE

BACKGROUND

The desirability of multifunction tools is driven by a number of significant factors. These include the ability to transport a tool capability having a diverse range of applications with minimal weight and taking up minimal space. Economic factors also create significant incentives increasing the desirability of multifunction tools. Limited space in apartments and homes also drives the desire to incorporate multiple functions in tools.

Early efforts at multiple function tools often took the form of introducing adjustability to a tool. For example, screw-adjustable wrenches came to take the place of multiple fixed wrenches. In the case of bicycle toolkits where space is particularly critical, dog bone wretches incorporating five sockets at each of the two ends addressed size, weight and economic concerns.

Conventional fixed screwdrivers have come to be largely replaced by screwdrivers incorporating a socket adapted to receive a plurality of bits which may be stored in a turret around the base of the drive shaft or in the handle of the screwdriver.

SUMMARY OF THE INVENTION

Over the years, the objective of introducing multiple functions into tools have taken numerous forms. For example, welding guns and drills have incorporated lights which illuminate the workpiece. One such drill is shown in U.S. Pat. No. 5,169,225 which illustrates a drill incorporating a workpiece illuminating light in its base. Yet another approach to the implementation of multiple functions is the use of a single power supply base which may be coupled to a number of tools, such as a flashlight, a hedge clipper or the like. Such a system is illustrated in U.S. Pat. No. 4,050,003 of Owings.

In accordance with the invention, a multiple function tool comprises a tool housing. An electrically powered tool is contained within the tool housing. At least one electrical tool contact is associated with the housing. A battery housing mates with and is secured to the tool housing when the battery housing is positioned on the tool housing in a use position. A rechargeable battery is contained within the battery housing. At least one battery contact is positioned to be connected to the electrical tool contact when the battery housing is mounted on the tool housing in the use position. A light emitting device is positioned at one end of the battery housing. The light emitting device is electrically connected to the battery. A switch couples the battery to the light emitting device.

The multiple function tool may further comprise a selection switch to couple the battery to the electrically powered tool. A recharging electrical power supply circuit may be driven by a pair of prongs configured to be connected to a recharging power source such as house current or the electrical system in a vehicle. The prongs may be rotated from a position extending substantially vertically from a surface of the battery housing to a position below the surface of the battery housing.

The inventive multiple function tool, may be a drill, a screwdriver, a power screwdriver or a device that performs all of these functions. The tool may incorporate a hexagonal socket chuck. The battery housing may slidably mounts onto a handle portion of the tool housing. The light emitting device may comprise a plurality of light sources and a switch for varying the number of light sources which are activated. This switch may be disposed on a flat portion of the battery housing.

The surface of the battery housing opposite the flat portion is optionally but preferably rounded.

The multiple function tool may include a light for illuminating a workpiece to be operated on by the multiple function tool.

A multiple light meter may be included to indicate the state of charge of the rechargeable battery. A strap may be coupled to a handle portion of the tool housing. A boot may extend around the base portion of a handle portion on the tool housing.

BRIEF DESCRIPTION OF THE FIGURES

These and other objects advantages of the invention will become apparent from the following description taken in conjunction with the figures, in which.

DETAILED DESCRIPTION OF THE BEST MODE OF THE INVENTION

Figure 1:
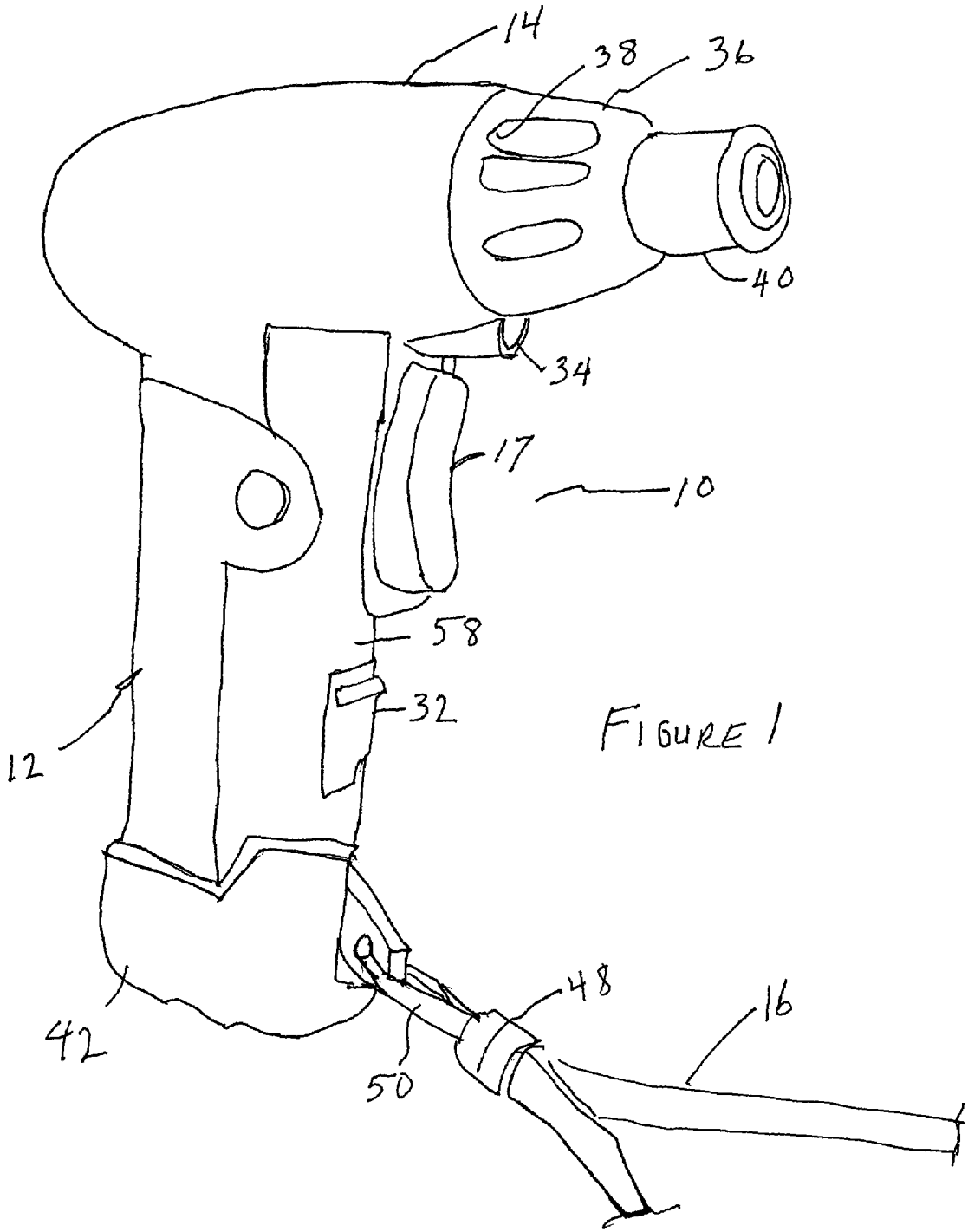
FIG. 1 is a perspective view of the inventive multiple function tool.

Referring to FIG. 1, a multiple function tool 10, such as a cordless drill-screwdriver, constructed in accordance with the present invention is illustrated. Tool 10 includes a handle portion 12 and a head assembly 14. A strap assembly 16 is provided to allow for convenient carrying of the tool.

Figure 2:
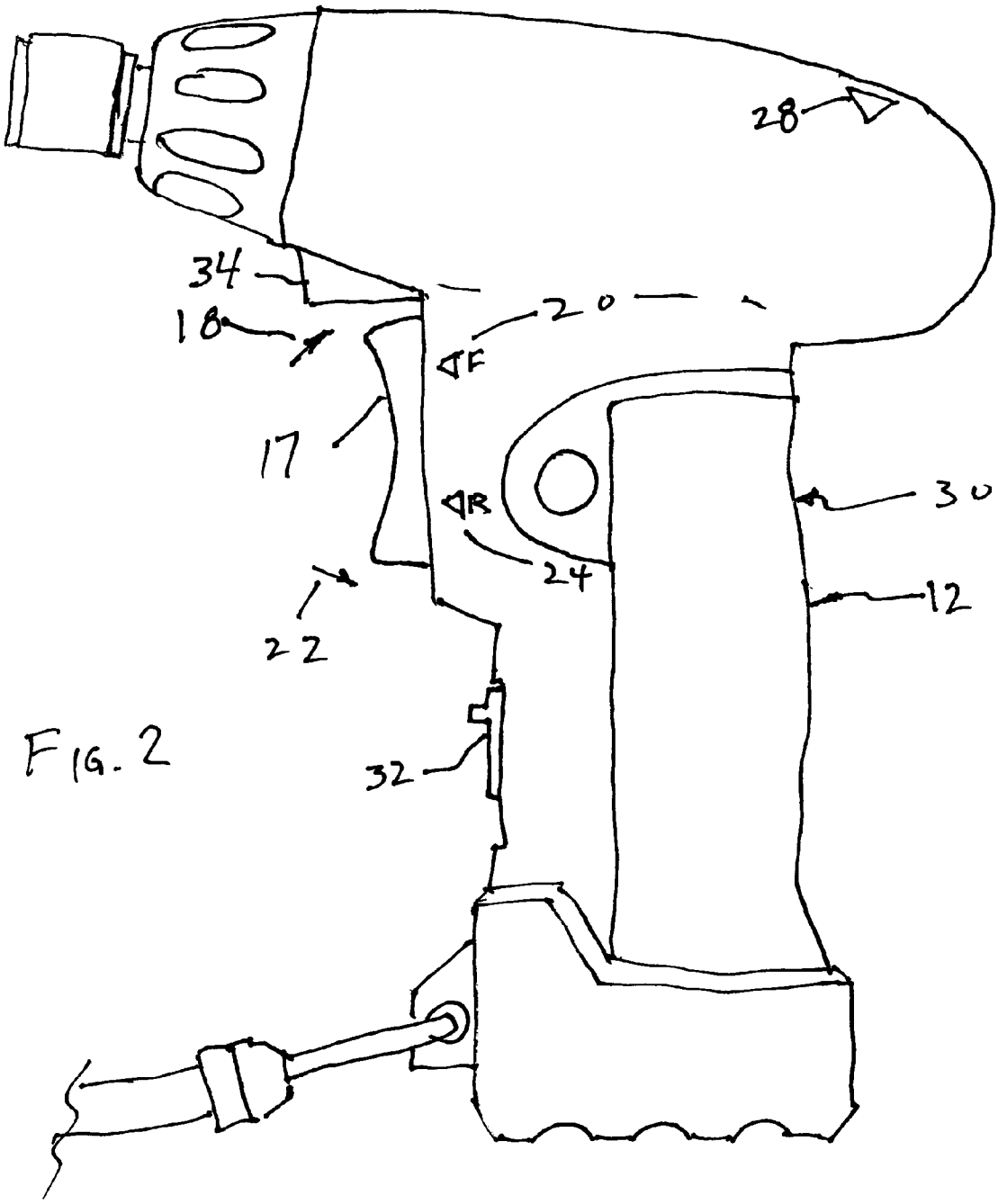
FIG. 2 is a side view of the inventive multiple function tool.

Referring to FIG. 2, handle portion 12 includes a forward-reverse rocker switch 17. Forward-reverse switch 17 is shown in the neutral position in FIG. 2 but may be rotated in the direction of arrow 18 to cause, for example, the advancement of a screw into a tapped hole. An indicating marking 20, comprising the designation "<F" may be used to indicate the result of rocking advancement of switch 17 in the direction of arrow 18. Forward-reverse switch 17 may also be rotated in the direction of arrow 22 to cause, for example, the unscrewing of a screw from a tapped hole. An indicating marking 24, comprising the designation "<R" may be used to indicate the result of advancement in the direction of arrow 22.

A forward indicator 26 is located at the rear end of head assembly 14. Forward indicator 26 comprises a relatively low intensity light emitting diode source and lights up upon depression of the upper end of switch 17 in the direction indicated by arrow 18. Forward indicator 26 is located at the rear end of head assembly 14. Reverse indicator 28 comprises a relatively low intensity light emitting diode source or other light emitting device and lights up upon depression of the lower end of switch 17 in the direction indicated by arrow 22.

Head assembly 14 houses a motor (not illustrated) which is coupled by switch 17 and battery connection contacts to a battery pack 30. The electrical connections between switch 17, the battery connection contacts on battery pack 30 and the remainder of handle portion 12, and battery pack 30 are of conventional design. Also in a manner conventional to the prior art, a battery on-off switch 32 is coupled to battery pack 30 and a workpiece illuminating light 34 located on head assembly 14. When on-off switch 32 is operated, it turns on or shuts off light 34. Light 34 may be a light emitting diode or other solid-state light emitting device and, in accordance with the preferred embodiment, light 34 emits light with an intensity greater than that of indicators 26-28, in order to provide sufficient illumination to a workpiece which is being drilled, screwed, or otherwise acted upon by the inventive tool 10.

Figure 3:
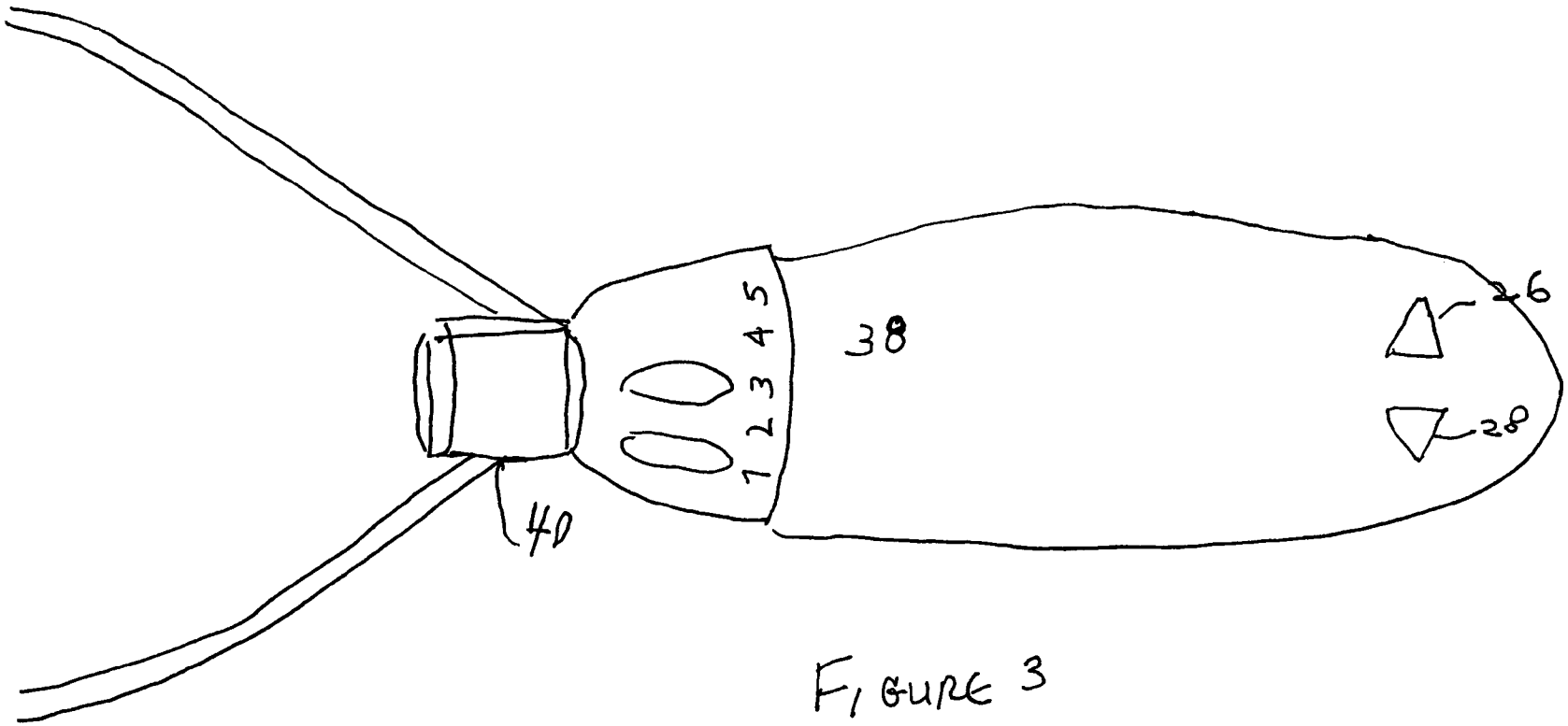
FIG. 3 is a top plan of the head of the inventive multiple function tool during assembly.

Tool 10 is provided with a conventional clutch mechanism, housed in head assembly 14, not illustrated. This clutch mechanism is adjusted in a conventional manner by a rotatable collar 36, which is a calibrated with markings 38, in this case the numerals one through five, as illustrated in FIG. 3. Collar 36 may be rotated to vary the torque output by chuck 40 in a manner well-known in the art.

The clutch mechanism drives chuck 40, which may be a chuck of any conventional design. The particular chuck illustrated is a hex-socket chuck. Alternatively, a multiple finger gripping chuck of the type manufactured by Jacobs may be employed. Alternatively, self-tightening chucks may also be employed.

Handle portion 12 is provided with a boot 42. Boot 42 is made of a relatively rigid rubbery material and engages the bottom of handle portion 12 by friction and or locking structure such as a depressed area 44 on the base of handle 12 and a mating raised stud 46 in boot 42, as is illustrated most clearly in FIG. 4.

Strap 16 may be made of a length of extruded polyvinyl chloride polymer plastic secured in a socket 48 associated with a locking hook 50.

Figure 4:
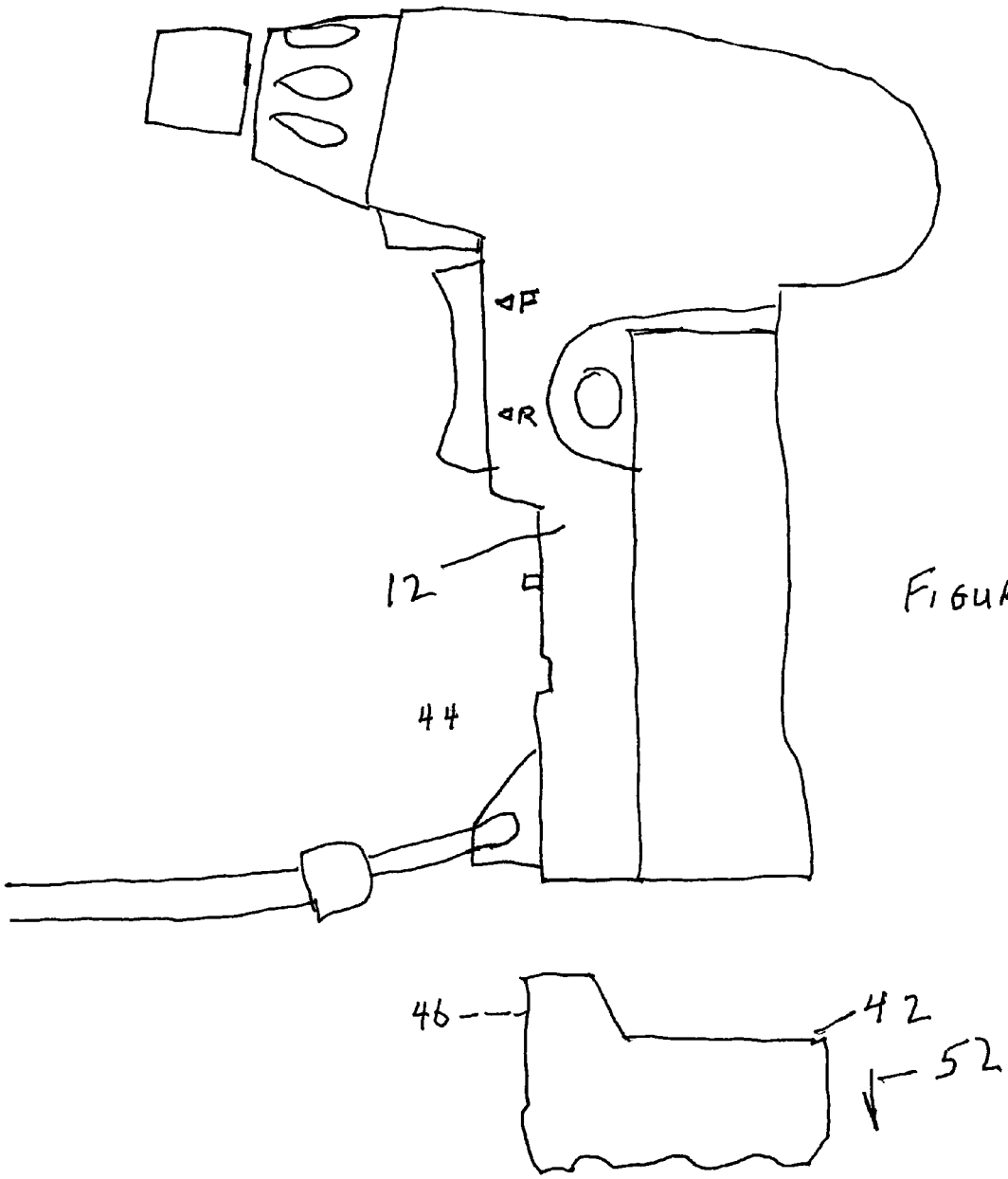
FIG. 4 is a side view of the head and handle of the inventive tool showing removal of the boot.

Boot 42 may be slid from handle portion 12 by sliding in the direction of arrow 52, as illustrated in FIG. 4. After boot 42 has been removed, a latch 53, of conventional design, which may be used to maintain battery pack 30 in position, may be released. Battery pack 30 may then be slid in the direction indicated by arrow 52, to remove it from the tool 10.

Figure 5:
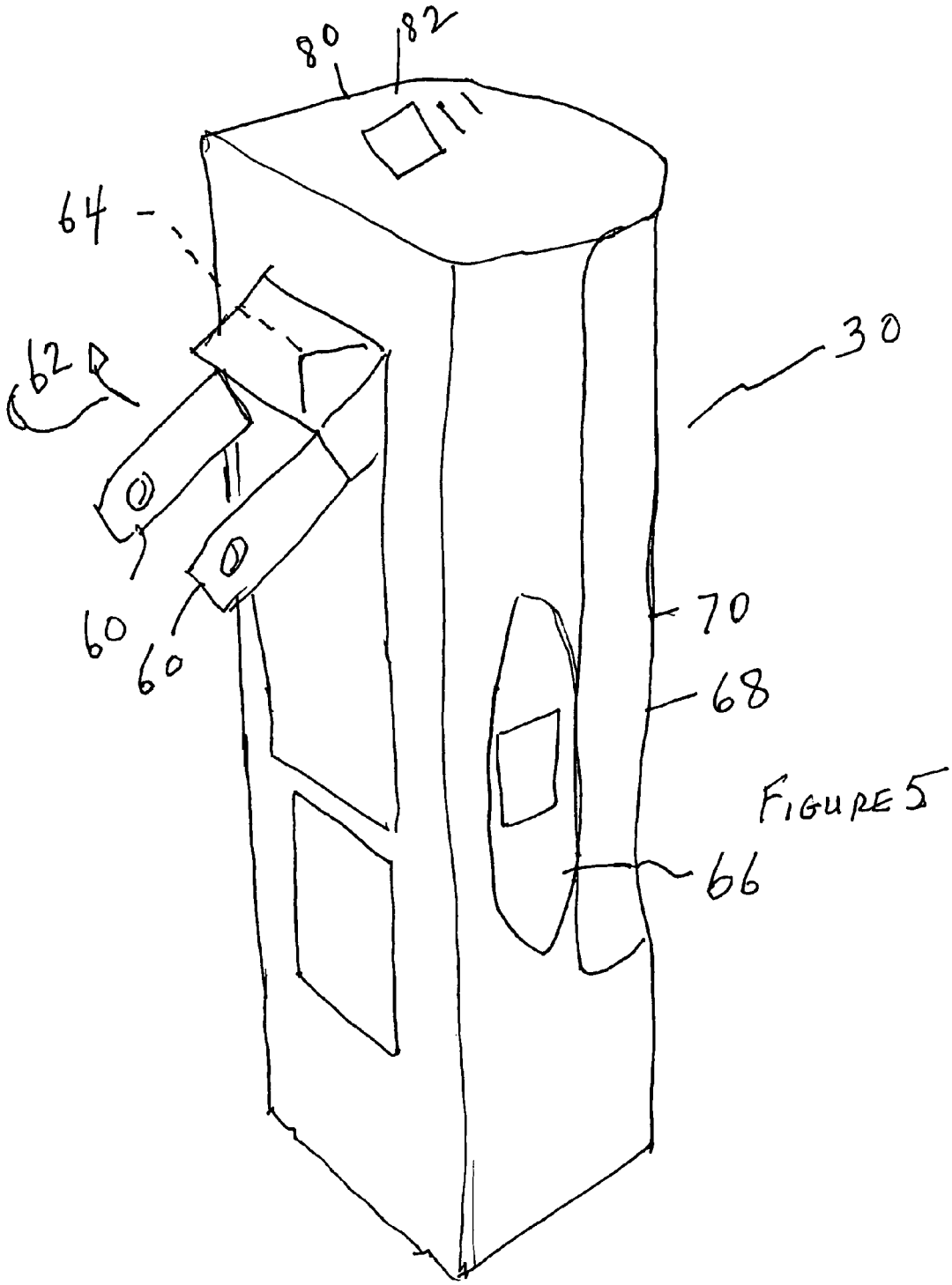
FIG. 5 is a perspective view of the housing for the rechargeable battery during orientation of the prongs for recharging.
Figure 6:
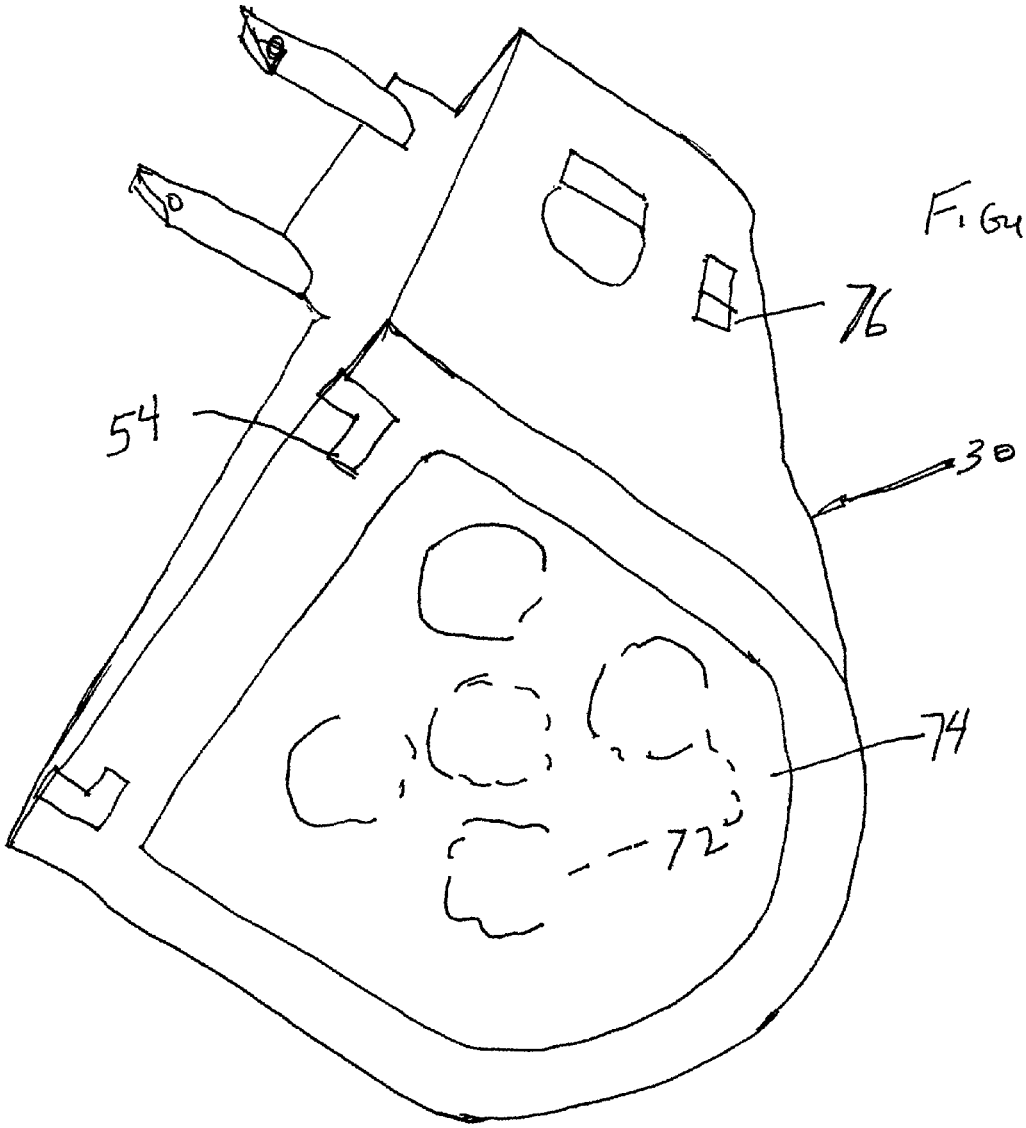
FIG. 6 is a perspective view of the rechargeable battery housing illustrating its configuration as a flashlight.

As illustrated in FIGS. 5 and 6, battery pack 30 incorporates L-channels 54, which mate with tracks 56 (FIG. 7) on main handle portion 58.

When it is desired to recharge battery pack 30, the battery pack is removed from the tool as described above. After the pack has been removed, rotatingly mounted male electrical current prongs 60 are rotated in the direction of arrow 62 from a stowed position to an intermediate position illustrated in FIG. 5 on and finally to a charging position illustrated in dashed lines in FIG. 5 with pronged base 64 extending vertically from battery pack 30.

Prongs 60 may then be inserted into an ordinary house current socket and the battery charged. Initially, if a battery is uncharged, red light 66 is lit. When half charge is achieved, yellow light 68 only is illuminated. Finally, when full charge is achieved, only green light 70 is illuminated. Battery pack 30 may then be replaced into tool 10 and continue to power operation of tool 10.

Alternatively, as illustrated in FIG. 6, battery pack 30 also incorporates one or, as illustrated, a number of light emitting diodes 72 placed behind an optional lens 74. Lens 74 may be simply a clear flat plastic member made from a sheet of clear plastic material or may have a focusing or other optical function. Light emitting diodes 72 have relatively high intensity compared to the other light emitting diodes on tool 10. They thus act as a very effective flashlight. Their operation may be controlled by a switch 76 which may be a simple on-off switch, or it may be a switch which selectively illuminates 1, 3 or five of the light emitting diodes 72.

Figure 7:
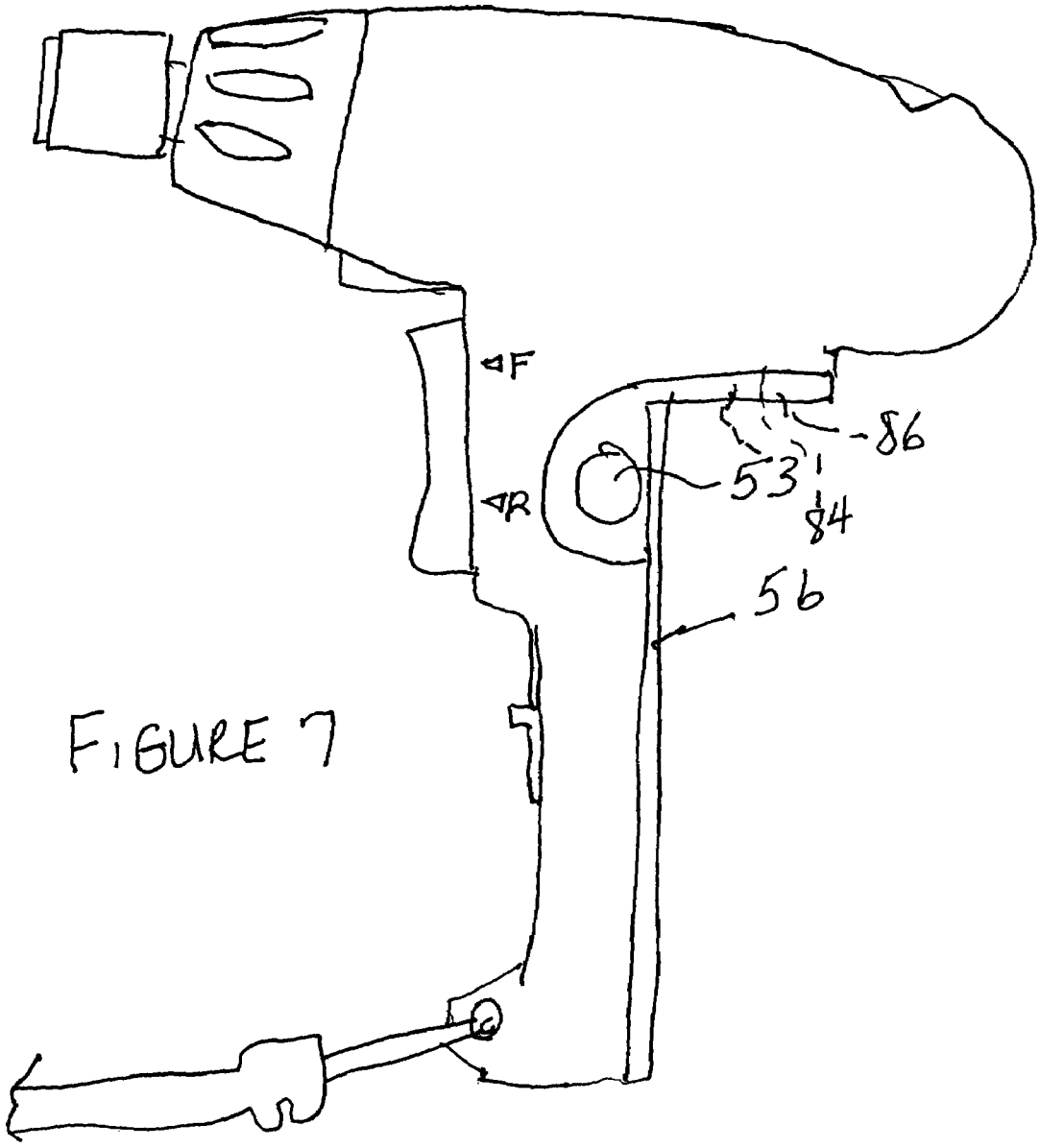
FIG. 7 is a side view of the inventive tool with the battery housing removed.
Figure 8:
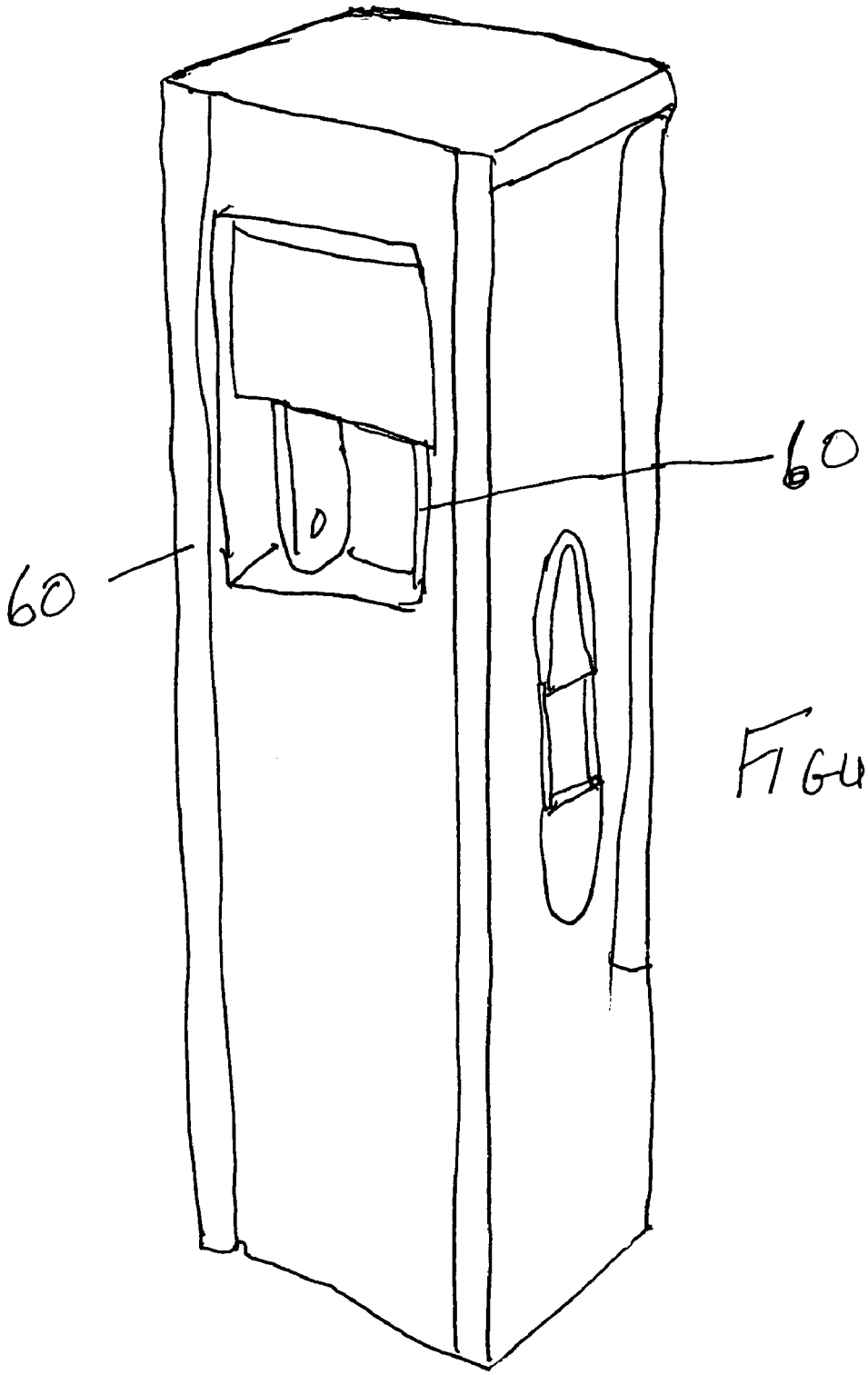
FIG. 8 is a perspective view of the battery housing with the prongs in the recharging position.

Power is coupled from battery pack 30 by a pair of electrical contacts 80 and 82 which mate with contacts 84 and 86 on the tool body, as illustrated most clearly in FIGS. 6 and 7. The battery pack 30 with prongs 60 fully in the retracted position is illustrated in FIG. 8.

While an illustrative embodiment of the invention has been described, it is, of course, understood that various modifications may be made from the illustrated embodiment of the invention without departing from the spirit and scope of the invention, which is limited and defined only by the following claims.

The invention claimed is:

1. A multiple function tool, comprising:

(a) a tool housing;

(b) an electrically powered tool contained within said tool housing;

(c) at least one electrical tool contact associated with said tool housing, said tool contact being coupled to provide power to said electrically powered tool;

(d) a battery housing, said battery housing configured and dimensioned to mate with and be secured to said tool housing when said battery housing is positioned on said tool housing in a use position such that said tool housing and said battery housing form a grip portion of the multiple function tool;

(e) a rechargeable battery contained within said battery housing;

(f) at least one battery contact positioned to be connected to said electrical tool contact when said battery housing is mounted on said tool housing in the use position;

(g) a light emitting device positioned substantially within said battery housing, said light emitting device being electrically connected to said battery, said battery housing being configured to be removed from said tool housing, said light emitting device being secured to said battery housing whereby said light emitting device is removed from said tool housing together with said battery housing, and said battery housing is a flashlight when removed from said tool housing;

(h) a recharging electrical power supply circuit with an electrical characteristic adapted to convert power coupled from an alternating current household mains power source to a voltage for recharging said battery, said recharging electrical power supply circuit being positioned within said battery housing; and (i) an electrical connector, associated with said battery housing and configured to be removed from said tool housing together with said battery housing, said electrical connector being configured to be connected to a recharging power source.

2. A multiple function tool as in claim 1, further comprising a switch, positioned on said battery housing, to couple said light emitting device to said rechargeable battery.

3. A multiple function tool as in claim 1, wherein said electrical connector comprises a pair of prongs configured to be connected to a recharging power source.

4. A multiple function tool as in claim 3, wherein said prongs may be rotated from a position extending from a surface of said battery housing to a position below said surface of said battery housing.

5. A multiple function tool as in claim 1, wherein said tool is a power screwdriver.

6. A multiple function tool as in claim 1, wherein said tool incorporates a hexagonal socket chuck.

7. A multiple function tool as in claim 1, wherein said battery housing slidably mounts onto a handle portion of said tool housing.

8. A multiple function tool as in claim 1, wherein said light emitting device comprises a plurality of light sources and further comprising a switch for varying the number of light sources which are activated.

9. A multiple function tool as in claim 1, wherein a switch is disposed on a flat portion of said battery housing, and wherein the surface of said battery housing opposite said flat portion is rounded.

10. A multiple function tool as in claim 1, further comprising a light for illuminating a workpiece to be operated on by said multiple function tool.

11. A multiple function tool as in claim 1, further comprising a multiple light meter indicating the state of charge of said rechargeable battery.

12. A multiple function tool as in claim 1, further comprising a strap coupled to a handle portion of said tool housing.

13. A multiple function tool as in claim 1, further comprising a boot extending around the base portion of a handle portion on said tool housing.

14. A multiple function tool as in claim 1, wherein said tool is a power tool with a handle and said battery housing forms a part of said handle.

15. A multiple function tool as in claim 1, wherein said battery housing and said light emitting device are configured to operate as a flashlight when said battery housing is disassembled from said tool housing.

16. A multiple function tool as in claim 1, wherein said tool housing and said battery housing form a grip portion of the multiple function tool.

17. A multiple function tool, comprising:

(a) a tool housing;

(b) an electrically powered tool contained within said tool housing;

(c) at least one electrical tool contact associated with said tool housing said tool contact being coupled to provide power to said electrically powered tool;

(d) a battery housing, said battery housing configured and dimensioned to mate with and be secured to said tool housing when said battery housing is positioned on said tool housing in a use position, said battery housing and said tool housing together forming a continuous shape at an interface of said battery housing and said tool housing when said battery housing and said tool housing are in said use position, such that said battery housing and said tool housing form a grip for the multiple function tool;

(e) a rechargeable battery contained within said battery housing;

(f) at least one battery contact positioned to be connected to said electrical tool contact when said battery housing is mounted on said tool housing in the use position; and (g) a light emitting device positioned within said battery housing, said light emitting device being electrically connected to said battery, said battery housing being configured to be removed from said tool housing, said light emitting device being secured to said battery housing whereby said light emitting device is removed from said tool housing together with said battery housing, and said battery housing is a flashlight when removed from said tool housing.

18. A multiple function tool as in claim 17, wherein said battery housing has a length substantially longer than its width.

19. A multiple function tool as in claim 17, wherein said battery housing and said light emitting device are configured to operate as a flashlight when said battery housing is disassembled from said tool housing.

20. A multiple function tool, comprising:

(a) a tool housing;

(b) an electrically powered tool contained within said tool housing;

(c) a battery housing, said battery housing configured and dimensioned to mate with and be secured to said tool housing when said battery housing is positioned on said tool housing in a use position, said battery housing having a height and a width, and a length, said length being several times longer than said height, and said length being several times longer than said width, said height and said width being of a dimension which allows said battery housing to be gripped by the hand of the user;

(d) a rechargeable battery contained within said battery housing;

(e) a light emitting device positioned within said battery housing, said light emitting device being electrically connected to said battery, said battery housing being configured to be removed from said tool housing, said light emitting device being secured to said battery housing whereby said light emitting device is removed from said tool housing together with said battery housing, and said battery housing is a flashlight when removed from said tool housing.

* * * * *